US006517151B2

(12) United States Patent
Liu

(10) Patent No.: US 6,517,151 B2
(45) Date of Patent: Feb. 11, 2003

(54) SAFETY FASTENING LATCH FOR LEISURE CHAIR

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 09/824,098

(22) Filed: Apr. 3, 2001

(65) Prior Publication Data

US 2002/0140255 A1 Oct. 3, 2002

(51) Int. Cl.[7] ..... A47C 4/30
(52) U.S. Cl. ..... 297/16.1; 297/16.2; 297/39
(58) Field of Search ..... 297/16.1, 35, 39, 297/16.2

(56) References Cited

U.S. PATENT DOCUMENTS 4,536,026 A * 8/1985 Cornell ..... 297/39
4,693,510 A * 9/1987 Marchesini ..... 297/39
5,054,848 A * 10/1991 Liu ..... 297/16.1 X
5,707,105 A * 1/1998 Liu ..... 297/16.1 X
5,735,570 A * 4/1998 Tseng ..... 297/39
5,899,525 A * 5/1999 Tseng ..... 297/16.1 X
5,964,500 A * 10/1999 Lin ..... 297/16.1
6,095,596 A * 8/2000 Chen ..... 297/39
6,206,462 B1 * 3/2001 Huang ..... 297/16.1 X
6,386,627 B1 * 5/2002 Tsai ..... 297/16.1

* cited by examiner

*Primary Examiner*—Rodney B. White
(74) *Attorney, Agent, or Firm*—Bacon & Thomas, PLLC

(57) ABSTRACT

A simple safety fastening latch for leisure chair comprises a slidable latch member mounted on an upper tubular portion of a foldable leg and a pivotal member fastened to a lower tubulare portion of the leg. The latch member has an inside wall which has a plurality of first ridges formed thereon. The pivotal member has a tongue section formed at an upper edge thereof. The tongue section also has a plurality second ridges formed thereon. When the latch member is slid to the tongue section, the first ridges will engage with the second ridges to enable the leisure chair be positioned securely.

4 Claims, 4 Drawing Sheets

SAFETY FASTENING LATCH FOR LEISURE CHAIR

BACKGROUND OF THE INVENTION

This invention relates to a simple safety fastening latch for leisure chair that provides a simple and safe fastening means on a folding foot support to enable the leisure chair positioning securely.

A conventional leisure chair usually has a safety fastening means to enable the chair positioning securely when in use. FIG. 1 shows one of the commonly used safety means which includes a latch blade B pivotally mounted on an upper tubular member A1 of the foot support A. The latch blade B has an engaging notch B1 formed at one end and a lug B2 extended sidewards. The foot support A further has a lower tubular member A2 which has a tenon C located thereon. The latch blade B may be turned toward the tenon C for the notch B1 engaging with the tenon C thereby to form a secure fastening for positioning the chair.

While the fastening means set forth above can attain a secure positioning for the leisure chair, the lug B2 of the latch blade B is protrusive outwards and is prone to get hit or entangled incidentally when people passing by, especially the children. As a result, the chair could be toppled unintentionally and cause injury to people. Moreover, the conventional fastening means mostly have relatively complicated construction and not enough safety function.

There are still rooms for improvement in the safety fastening means for leisure chair especially in the aspect of guarding it from being easily moved by children and to enhance its safety without comprising its convenience.

SUMMARY OF THE INVENTION

It is therefore an object of this invention to provide a slidable and simple fastening means on the leg of a leisure chair to enable the leisure chair positioning securely and increasing its safety. This invention does not have any protrusive section and has an attractive appearance without losing its convenience.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENT

Figure 1:
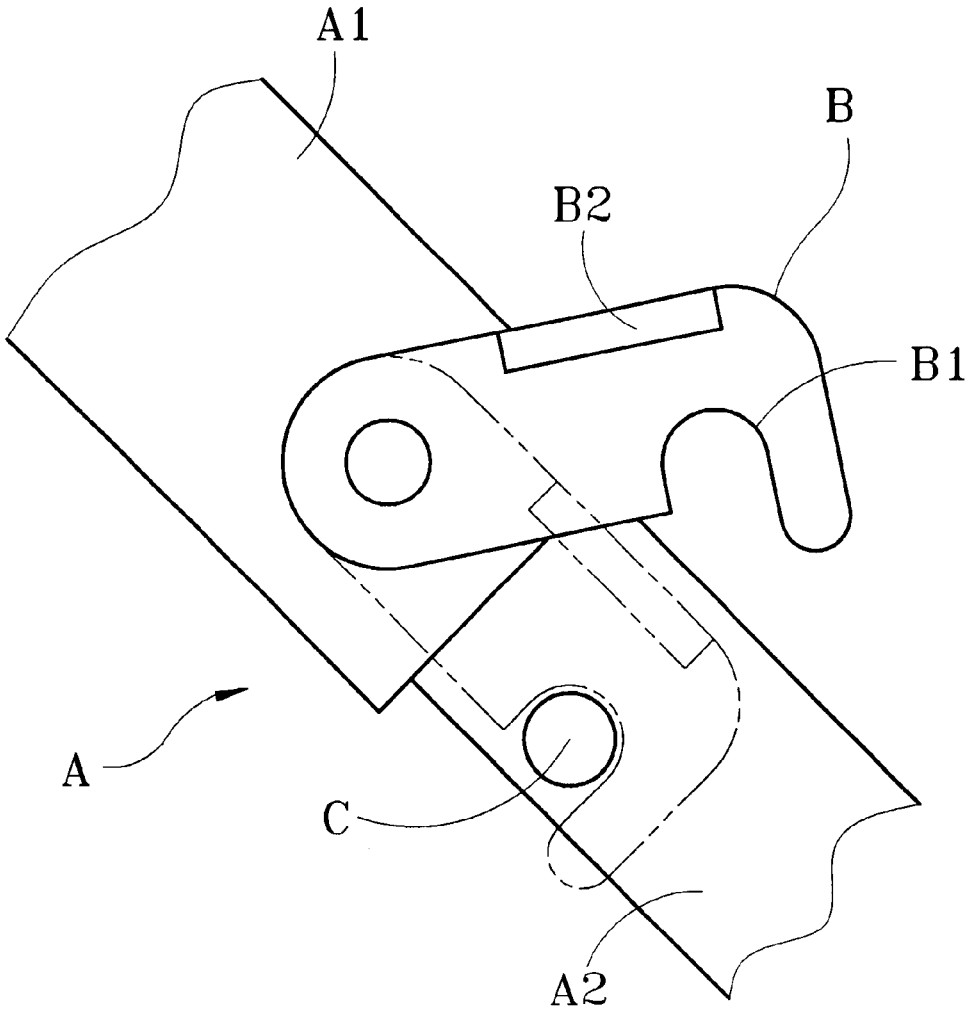
Fig.1 PRIOR ART
FIG. 1 is a schematic view of a conventional fastening means for a leisure chair.
Figure 2:
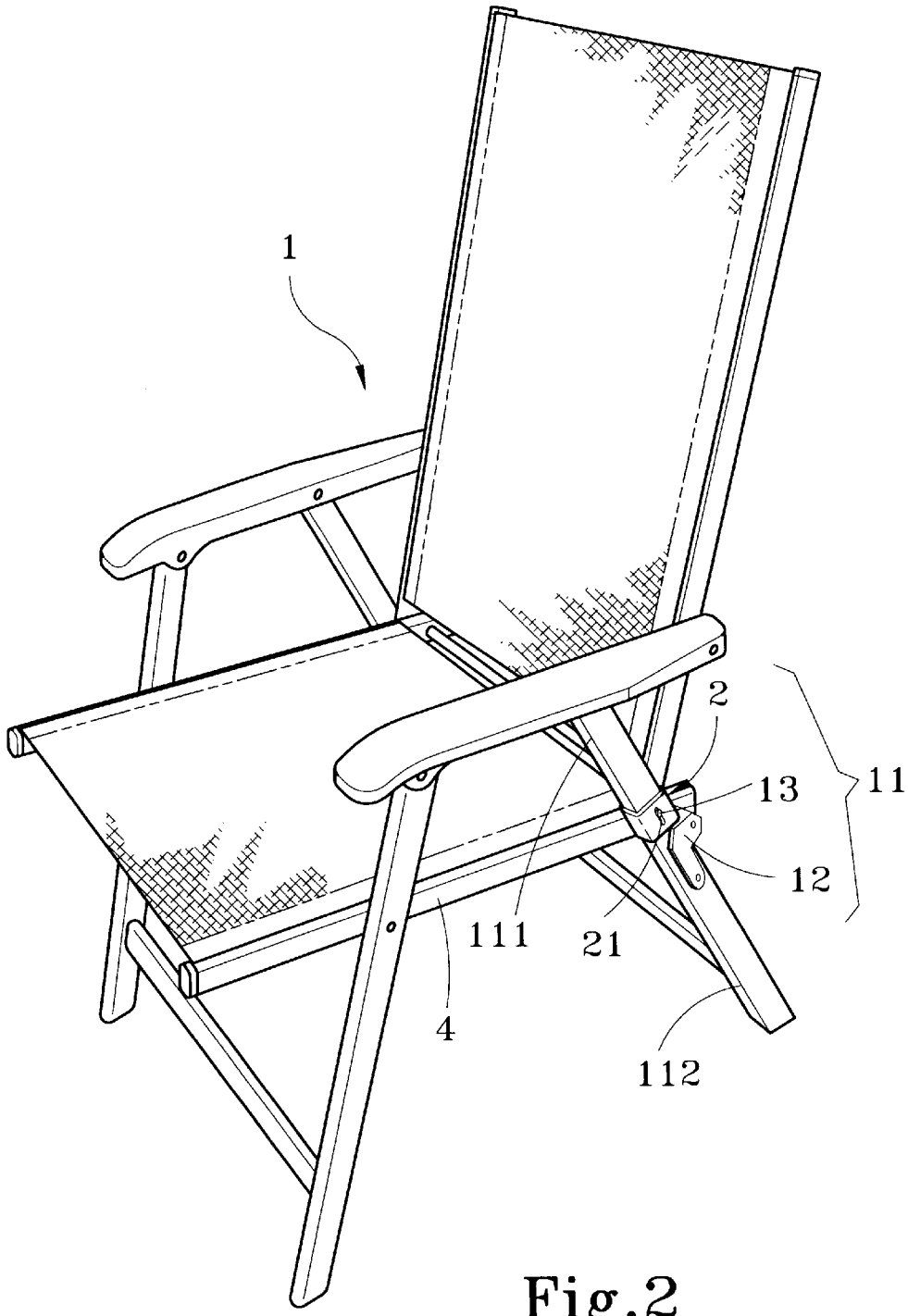
FIG. 2 is a pictorial view of this invention in use.
Figure 3:
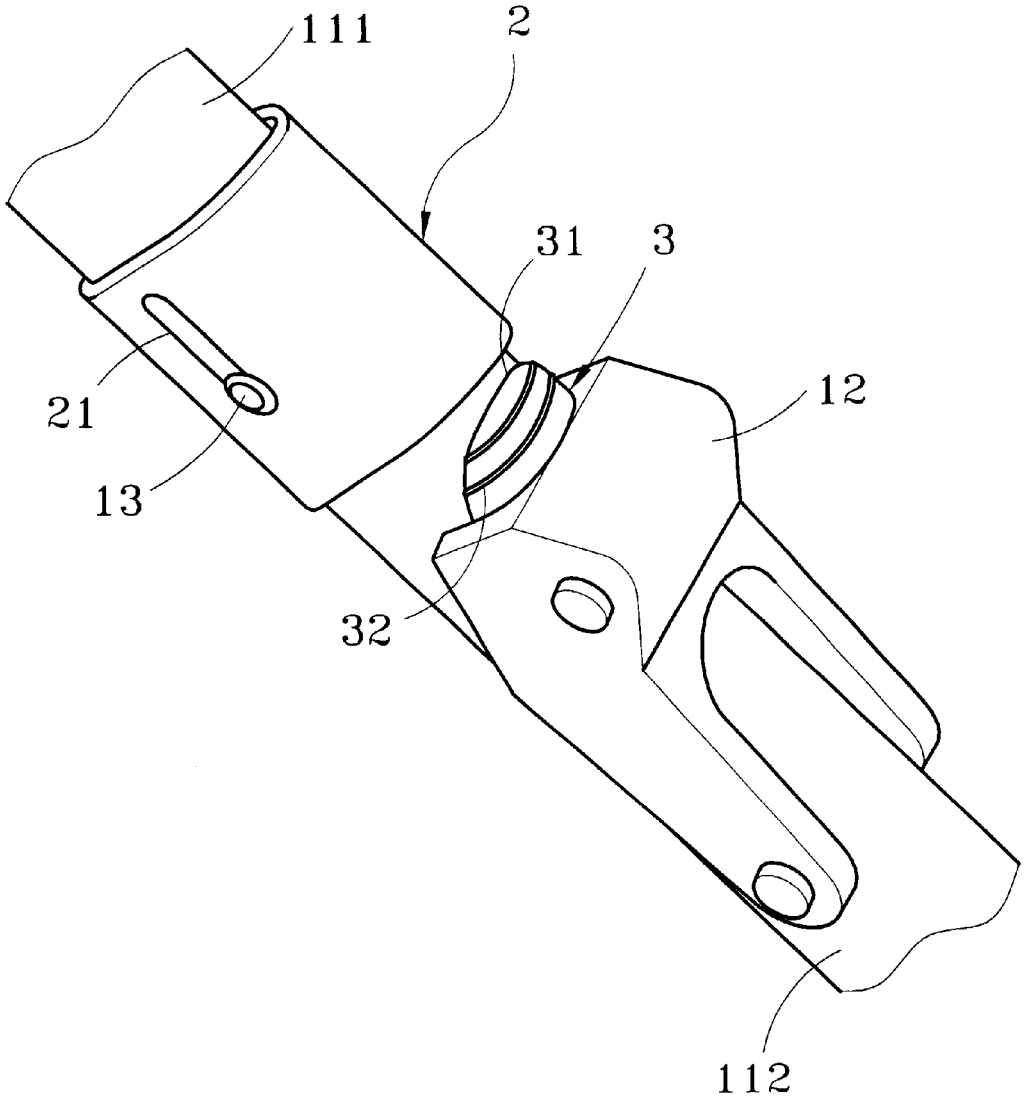
FIG. 3 is a perspective view of this invention.
Figure 4A:
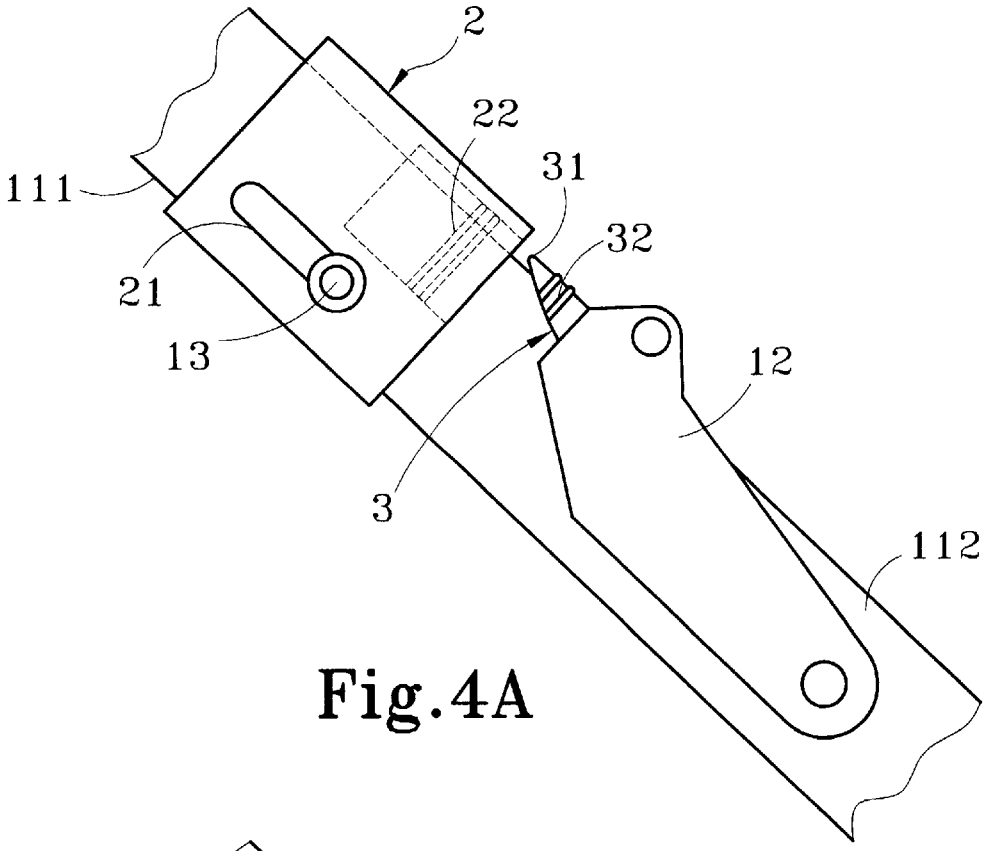
FIG. 4A is a side view of this invention in use.
Figure 4B:
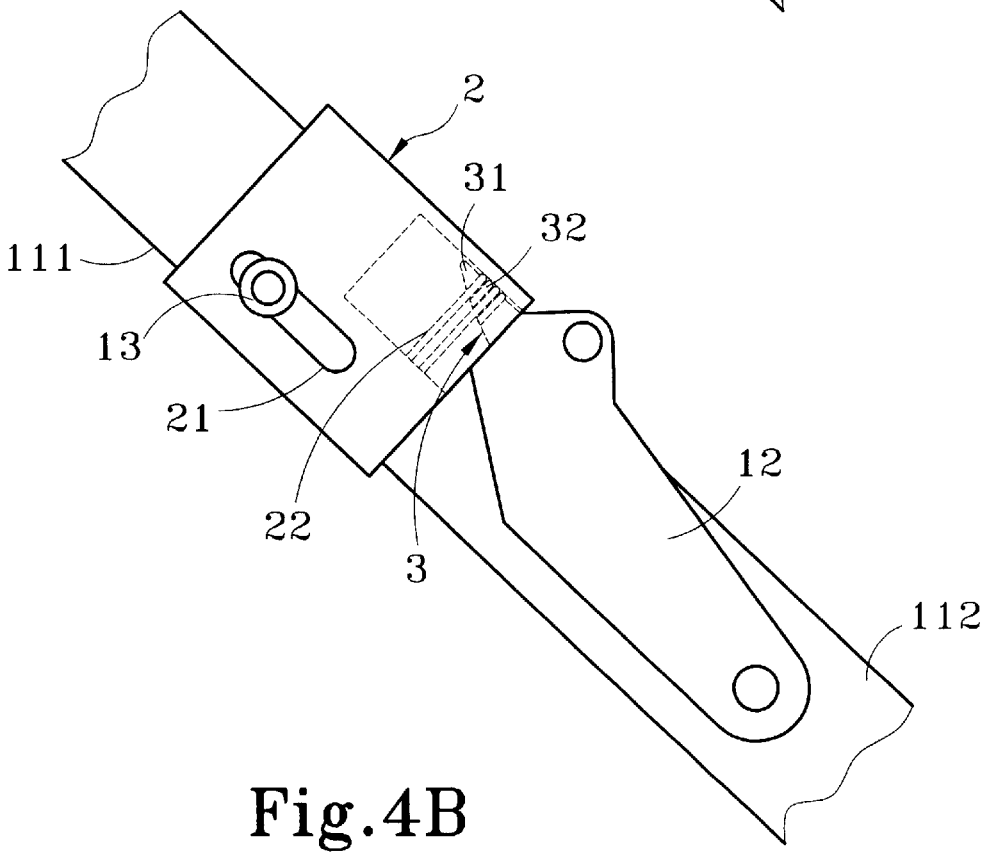
FIG. 4B is another side view of this invention in use.

Referring to FIGS. 2 and 3, the fastening latch according to this invention mainly includes a tenon 13 located at an upper tubular portion 111 of a leg support 11 of a leisure chair 1 to couple with a slidable latch member 2. The latch member 2 has a slot 21 to contain the tenon 13 therein so that the latch member 2 may be slid about the tenon 13 without moving away. The latch member 2 has an inside wall which has a plurality of first ridges 22 formed thereon (as shown in FIG. 4A). The leg 11 has a lower tubular portion member 112 which has a pivotal member 12 fastened thereon. The pivotal member 12 has a tongue section 3 formed at one edge which has a slant guide section 31 and a plurality of second ridges 32 formed thereon.

As shown in FIGS. 2, 3, 4A and 4B, the pivotal member 12 is hingeably attached to the lower tubular portion 112 and the seat frame 4, such that when the latch member slides over the slant guide section 31 of the pivotal member 12, the tubular portions 111, 112 are interlocked with the seat frame 4.

Referring to FIGS. 4A and 3B, when in use, move the latch member 2 along the slot 21 towards the tongue section 3, and through the slant guide section 31 to engage the latch member 2 ith the tongue section 3, with the first ridges 22 engaged with toh second ridges 32. Thus the leisure chair 1 may be positioned securely By means of aforesaid construction, the slidable latch member and pivotal member on the foldable leg may be engaged easily and securely without any protrusive parts. It thus can position the leisure chair steadily with enhanced safety without losing the convenience. The appearance is also more attractive than conventional one.

What is claimed is:

1. A safety fastening latch in combination with a leisure chair, comprising:

a leg comprising an upper tubular portion and a lower tubular portion;

a latch member slidable on the upper tubular portion;

a pivotal member fastened to the lower tubular portion of the leg, the pivotal member having a tongue section formed at one edge thereof for engaging with the latch member when the latch member is slid towards the tongue section in order to securely position the pivotal member to the latch member and wherein the upper tubular portion has a tenon engageable with a slot formed in the latch member for the latch member to slide thereon.

2. The safety fastening latch in combination with a leisure chair of claim 1, wherein the latch member has an inside wall which has a plurality of first ridges formed thereon.

3. The safety fastening latch in combination with a leisure chair of claim 1, wherein the tongue section has a slant guide section.

4. The safety fastening latch in combination with a leisure chair of claim 1, wherein the tongue section has a plurality of second ridges formed thereon.

* * * * *